US012151281B2

(12) United States Patent
Pfannenstiel et al.

(10) Patent No.: US 12,151,281 B2
(45) Date of Patent: Nov. 26, 2024

(54) VERTICALLY DIVIDED FEEDER FOR USE IN METAL CASTING IN CASTING MOLDS AND METHOD FOR PRODUCTION THEREOF

(71) Applicant: CHEMEX FOUNDRY SOLUTIONS GMBH, Delligsen (DE)

(72) Inventors: Alex Pfannenstiel, Tuttlingen (DE); Heiko Schirmer, Delligsen (DE)

(73) Assignee: CHEMEX FOUNDRY SOLUTIONS GMBH, Delligsen (DE)

( * ) Notice: Subject to any disclaimer, the term of this patent is extended or adjusted under 35 U.S.C. 154(b) by 0 days.

(21) Appl. No.: 18/547,376

(22) PCT Filed: Feb. 23, 2022

(86) PCT No.: PCT/EP2022/054539
§ 371 (c)(1),
(2) Date: Aug. 22, 2023

(87) PCT Pub. No.: WO2022/180103
PCT Pub. Date: Sep. 1, 2022

(65) Prior Publication Data

US 2024/0123493 A1 Apr. 18, 2024

(30) Foreign Application Priority Data

Feb. 24, 2021 (DE) ..... 10 2021 104 435.9

(51) Int. Cl.
*B22C 9/08* (2006.01)

(52) U.S. Cl.
CPC ..... *B22C 9/088* (2013.01)

(58) Field of Classification Search
CPC ..... B22C 9/08; B22C 9/084; B22C 9/088
See application file for complete search history.

(56) References Cited

U.S. PATENT DOCUMENTS

| | | | |
|---|---|---|---|
| 5,291,938 | A | 3/1994 | Metevelis |
| 2015/0034801 | A1 | 2/2015 | Lemarchand |

(Continued)

FOREIGN PATENT DOCUMENTS

| | | |
|---|---|---|
| CN | 110153376 | 8/2019 |
| DE | 2428885 | 1/1976 |

(Continued)

*Primary Examiner* — Kevin E Yoon
(74) *Attorney, Agent, or Firm* — DUANE MORRIS LLP; Gregory M. Lefkowitz; Brandon A. Chan

(57) ABSTRACT

The invention relates to a feeder insert (1, 1', 1'', 1''', 100, 100') for use in metal casting in casting molds, comprising a feeder body (2, 2', 2'', 2''', 102, 102') which delimits a feeder cavity (4, 4', 4'', 4''', 104, 104') for receiving liquid metal, wherein the feeder body (2, 2', 2'', 2''', 102, 102') has a first end (6, 6', 6'', 6''', 106, 106') having a passage opening (8) for the liquid metal and a second end (10, 10', 10'', 10''', 110, 110') opposite the first end (6, 6', 6'', 6''', 106, 106'), and wherein the feeder body (2, 2', 2'', 2''', 102, 102') comprises a central axis (Z) extending through the passage opening (8). The feeder body (2, 2', 2'', 2''', 102, 102') is separated at least one partition plane (E) extending in a direction of the central axis (Z) and is formed at least from a first feeder shell (18, 18', 18'', 18''', 118, 118') and a second feeder shell (20, 20', 20'', 20''', 120, 120'). The first and second feeder shells (18, 18', 18'', 18''', 118, 118') are connected to each other to form the feeder body (2, 2', 2'', 2''', 102, 102').

27 Claims, 11 Drawing Sheets

(56) References Cited

U.S. PATENT DOCUMENTS

Figure 1:
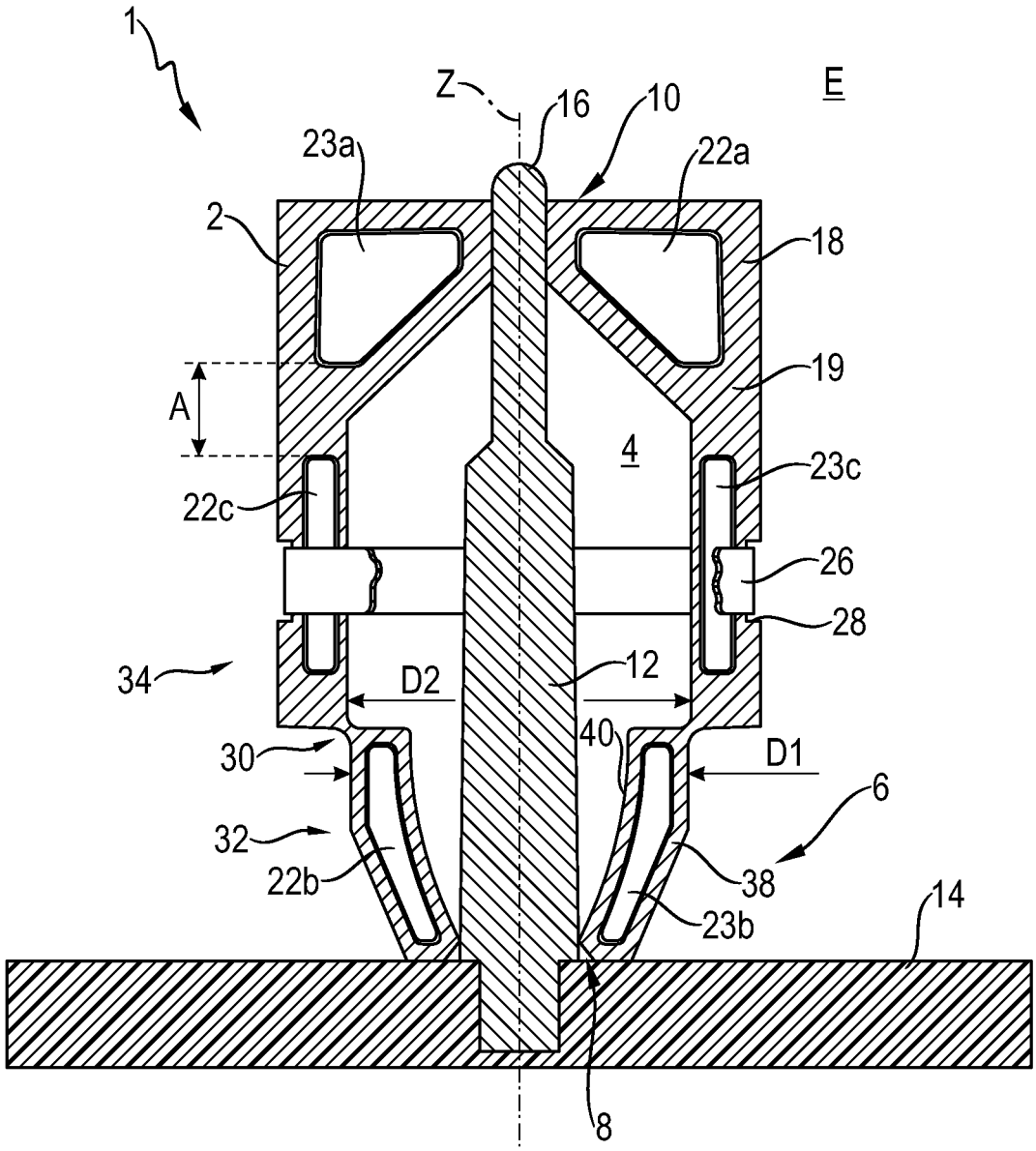

| | | | |
|---|---|---|---|
| 2016/0101461 | A1 | 4/2016 | Beckmann |
| 2017/0209917 | A1 | 7/2017 | Volks |
| 2018/0257132 | A1 | 9/2018 | Baginski |

FOREIGN PATENT DOCUMENTS

| | | | | |
|---|---|---|---|---|
| DE | 202021106147 | U1 * | 12/2022 | ..... B22C 9/088 |
| EP | 1184104 | | 3/2002 | |
| EP | 1775045 | | 4/2007 | |

* cited by examiner

VERTICALLY DIVIDED FEEDER FOR USE IN METAL CASTING IN CASTING MOLDS AND METHOD FOR PRODUCTION THEREOF

CROSS-REFERENCE TO RELATED APPLICATIONS

This application is a § 371 national stage entry of International Application No. PCT/EP2022/054539, filed on Feb. 23, 2022, which claims priority to German Patent Application No. 10 2021 104 435.9, filed on Feb. 24, 2021, the entire contents of which are incorporated herein by reference.

The invention relates to a feeder insert for use in metal casting in molds, comprising a feeder body which defines a feeder cavity for receiving liquid metal, the feeder body having a first end with a passage opening for the liquid metal and a second end opposite the first end, the feeder body comprising a central axis extending through the passage opening. The invention further relates to a method for production of such a feeder insert.

Feeder inserts are known in the prior art which are used for metal casting in molds. The feeder inserts are at least partially surrounded by a molding material used to produce the casting molds, such as molding sand. By means of the molding material surrounding the feeder insert, the feeder insert is held in a predetermined position within the casting mold or section of the casting mold. The feeder body thereby defines a feeder cavity within the feeder insert for receiving liquid metal used in casting. The feeder body comprises a first end with a passage opening for the liquid metal, which creates a connection to areas of a mold cavity of the mold part of the casting mold to be produced. A portion of the metal filled into the mold cavity of the casting mold during casting passes through the passage opening into the feeder cavity of the feeder insert. As the metal solidifies in the casting mold, the metal in the feeder cavity, which is kept in a liquid state, can flow back into the casting mold. In this way, shrinkage of the molded part can be compensated.

The feeder body has a second end opposite the first end through which the feeder cavity is closed. This forms an almost closed feeder cavity. In order to withstand the high pressures acting on the molding material used to produce the mold during the compacting process, feeder inserts which are variable in their overall height during compaction of the molding material to form a finished molded part are frequently used.

From the publication EP 1 184 104 A1 a feeder insert for use in metal casting is known, which has a feeder body and a feeder element, the feeder body and the feeder element being telescopically displaceable into one another sectionwise. During the compacting process, the feeder body and the feeder element are thus moved relative to one another. This two-part feeder insert has proven itself in practice.

On the other hand a one-piece feeder insert is known from DE 20 2012 102 546 U1. This feeder insert differs from the above-described feeder insert according to EP 1 184 104 A1 in particular in that the feeder element and feeder body are formed in one piece, i.e. as a single piece. This is intended to prevent individual elements, namely in particular the holding elements of the feeder insert described in EP 1 184 104 A1, from breaking off and mixing with the molding sand. In addition, this is intended to simplify production.

Even though this feeder insert works as well, there is still a need to improve feeder inserts of the type mentioned above. In particular, there is a need to facilitate production of such a feeder insert and to improve the insulation effect.

It has been shown that certain geometries, particularly those resembling a spherical shape, are best suited for keeping the liquid metal contained in the feeder cavity liquid at an elevated temperature for as long as possible. However, such feeder inserts can be manufactured only at great expense using conventional means, so that one object of the invention is to provide a remedy. A process for producing such a feeder is disclosed, for example, in DE 10 2015 115 437 A1.

For a feeder insert of the above mentioned type, the invention solves the object in that the feeder body is separated at least one partition plane extending in the direction of the central axis and in that the feeder body is formed from at least a first feeder shell and a second feeder shell, the first and second feeder shells being connected to each other to form the feeder body.

In a typical feeder essentially having a cylindrical shape, the central axis is the central axis of the cylindrical body. The central axis may be an axis of rotational symmetry, but this is not mandatory. The central axis extends through the passage opening and forms the central axis of the passage opening. This means that the central axis lies in the flow direction through the passage opening when the liquid metal enters and exits.

The feeder body is separated along at least one partition plane extending in the direction of the central axis. The partition plane may include the central axis or be offset parallel thereto. The feeder body may also be separated at two or more partition planes, which may be oriented at an angle to each other. In contrast to the feeder insert known, for example, from EP 1 184 104 A1, which is separated horizontally, the feeder insert according to the present invention is separated vertically. The feeder body is then formed by two or more feeder shells, namely in particular a first feeder shell and a second feeder shell. The feeder shells are assembled and joined together to form the feeder body, which then defines and borders the feeder cavity.

In this way, even a complex geometry of the feeder body can be easily produced by subdividing it into two or more feeder shells. In particular, the feeder body can comprise undercuts in the direction of the central axis, without the feeder cavity having to be formed internally by, for example, lost core technology or the like. Dividing the feeder shells into two vertically split halves further allows the feeder shells to be in other respects manufactured in one piece.

Connecting of the first and second feeder shells to each other may be by form-fit or substance-to-substance joining. For example, an adhesive may be applied to the first and second feeder shells, such as an adhesive dot, for example a hot melt adhesive dot. Since feeder inserts are loaded substantially in the direction of the central axis during use, the connection of the first and second feeder shells does not have to withstand particularly high forces.

In a first preferred embodiment, the first feeder shell comprises a first partition surface and the second feeder shell comprises a second partition surface corresponding to the first partition surface for connecting the first and second feeder shells to each other. The first and second partition surfaces are the surfaces by which the feeder shells are placed against each other to form the feeder body. The first and second partition surfaces may be substantially or completely flat. This is particularly preferred when the first and second feeder shells are bonded together, preferably by means of an adhesive.

In a preferred further embodiment, the first feeder shell comprises at least one first protrusion and at least one first recess and the second feeder shell comprises at least one second protrusion and a second recess, wherein the first protrusion engages the second recess and the second protrusion engages the first recess for connecting the first and second feeder shells. Preferably, the first and second protrusions and recesses are formed on the first and second partition surfaces. Alternatively, the first feeder shell may only have protrusions and the second feeder cup may only have recesses. For example, one or more first protrusions may be provided on the first partition surface and one or more first recesses corresponding to the first protrusions may be provided on the second partition surface. By means of the protrusions and recesses, the first and second feeder shells can be positively connected to each other. The protrusions and recesses therefore jointly form positive-locking elements for positively connecting the first and second feeder shells.

The protrusions and recesses can be designed such that the protrusions clamp in the corresponding recesses and thus the first and second feeder shells are held together solely due to this clamping. For this purpose, the protrusions may be formed with a slight oversize with respect to the corresponding recesses, generally conical or frustoconical, with clamping elements such as clamping ledges, clamping nubs or clamping ridges, and/or may have some kind of barb. Such a barb could also be formed of metal and arranged on the respective protrusion during the shooting of the respective feeder shell or subsequently. It is further possible to arrange clamping ring of some sort around one or more projections and/or in one or more of the recesses, which then enables the protrusion and recess to clamp together.

In a further preferred embodiment, the first and second feeder shells can be connected by means of one or more pins. For this purpose, the first and second feeder shells have corresponding first and second pin receptacles, which may be formed as blind holes or through holes, for example. A pin can then be arranged such that it extends into the corresponding holes and is held there by positive locking and/or force-fitting and/or substance-to-substance-jointing manner. A particularly simple solution is to use a wooden pin that is first placed in the pin receptacle in the first feeder shell, and that then enters into the second pin receptacle of the second feeder shell during joining with the second feeder shell. As an alternative to a wooden pin, a pin made of another material, preferably selected from molding compound, metal, plastic, paper, cardboard. The pin may be solid material or partially hollow.

Preferably, a spacing in a range of 20 mm or less, 15 mm or less, 10 mm or less, 5 mm or less, 3 mm or less is provided between each two adjacent protrusions or recesses. Intermediate ranges, preferably in 1 mm increments, are also provided. The protrusions or recesses are provided along the first and second partition surfaces. These then, also when engaging, form a barrier from the feeder cavity radially outward. If completely flat partition surfaces are provided, a gap may form between the abutting partition surfaces and form a straight passage from the interior of the feeder body to the radial exterior. In use, liquid metal can accumulate here, which may lead to so-called fins in the casting process. The engaging protrusions and recesses interrupt this and ensure that fins are short, namely only as long as the spacing between two adjacent protrusions or recesses. In addition, even better insulation is created since there is no direct passage between the two feeder shells.

According to a preferred embodiment, a section of 50% or less, 40% or less, 35% or less, 30% or less, measured along the central axis, is free of protrusions or recesses in total. The section free of protrusions or recesses is preferably selected to be as small as possible, so as to minimize a direct passage between the first and second feeder shells. The protrusions are preferably formed by not completely removing a material appendage of residual material passing through inlet openings of a core box in which the feeder shell was manufactured. Feeder inserts, and therefore also the feeder shells of the present invention, are shot from a molding material in so-called core boxes. Core boxes are boxes with a mold cavity into which the mold material is introduced, i.e. shot, by means of air pressure. Such core boxes generally have at least one, usually multiple, inlets to which so-called shot nozzles are connected in order to introduce the molding material. Since these inlets cannot be completely flush with the mold cavity, material appendages form there. By not completely removing these, the feeder shells have protrusions that can be used as protrusions within the scope of the present invention to positively connect the first and second feeder shells. This further simplifies the manufacturing process and may eliminate some or all of the work steps.

In order to hold the first and second feeder shells together in the connected state, a holding sleeve is preferably provided which partially or completely circumferentially surrounds the feeder body. This is particularly preferred if the feeder shells are only positively connected to one another, for example by engaging the protrusions and recesses. The holding sleeve is then preferably provided in order to secure the feeder shells to each other, so as to simplify transport and handling in use. It is particularly easy if the holding sleeve completely surrounds the feeder body. However the holding sleeve may only partially surround the feeder body and corresponding holders may be provided on the first and second feeder shells for this purpose.

Preferably, the holding sleeve is formed as: Paper sleeve, plastic sleeve, elastomer sleeve, rubber sleeve, metal sleeve, holding sleeve formed from renewable materials, holding sleeve formed from a substantially residue-free combustible material, or combinations thereof. A paper sleeve may either be a single piece or formed as a paper strip closed by means of an adhesive bond or attached to the feeder body by means of an adhesive bond, as is known, for example, from beverage bottle labels. A plastic sleeve can particularly be formed as a plastic film, in order to use as little material as possible. Elastomer and rubber sleeves are preferably designed as bands which, when under tension, surround the feeder body, preferably completely.

A metal sleeve or a plastic sleeve can be designed as a single-piece or multi-piece, open or closed ring or partial ring. A closed metal or plastic ring can, for example, simply be slipped onto the assembled feeder shells from above to secure them against each other. Alternatively, a metal ring in the fashion of a hose clamp can be used to secure the two feeder shells against each other. An open ring, which may for example be substantially C-shaped, can be slid over the first and second feeder shells transverse to the central axis in the manner of a clamp. Such a partial ring may also be formed of other materials having sufficient tension to hold the first and second feeder shells together.

A holding sleeve made of renewable materials can in turn be substantially similar to a paper sleeve and, for example, be formed from a fibrous material, such as hemp. The holding sleeve, also one of the type mentioned above, is preferably designed to be substantially residue-free combustible. This enables the molding sand in the casting mold to be kept free of debris.

For better retention of the holding sleeve, a circumferential recess for receiving the holding sleeve can be provided on the feeder body. The circumferential recess thus extends on the first and second feeder shells and can be formed, for example, as a circumferential groove. Alternatively, a retaining ridge may be provided which extends circumferentially on the feeder body and prevents the retaining collar from slipping down in at least one of the axial directions of the feeder body.

In a preferred embodiment of the invention, the feeder cavity comprises at least one undercut. The term undercut preferably refers to the passage opening from which a mold core would have to be removed if the feeder body were manufactured in one piece. Preferably, the undercut is to be understood in the direction of the central axis. Preferably, the feeder cavity is part-spherical or spherical. It has been found that due to the particularly advantageous ratio of surface area to volume, a spherical shape results in a particularly long temperature sustainability in the liquid metal received in the feeder cavity. The less favorable this ratio is, i.e. the smaller the ratio of volume to surface area, the sooner the liquid metal received in the feeder cavity cools down and can then no longer compensate sufficiently for shrinkage of the molded part during casting. Such a mold necessitates a small passage opening in relation to the feeder cavity, which starting from outside the feeder body widens inside the feeder body, i.e. in the feeder cavity. This in turn causes an undercut. According to the present invention, such a feeder body can be formed from two feeder shells. These feeder shells are thereby preferably free of undercuts and in this way easy to manufacture. For example, a partial spherical shape of a feeder cavity can be formed by two feeder shells which in turn define a hemisphere of the part-spherical shape in the interior and are thus each separately free of undercuts and thus easy to manufacture.

In a preferred further development, the feeder body tapers towards the passage opening and thereby defines a feeder neck. Preferably, the feeder body tapers towards the passage opening in a substantially frustoconical shape if the passage opening is circular. However, the passage opening may also be elongated so that the feeder body then tapers correspondingly to resemble an elongated cone. Through this, a notch is to be formed which, after solidification of the metal, facilitates removal of the feeder insert together with any metal which may then have hardened therein.

In a further preferred embodiment, the feeder body comprises at least one circumferential weak section which divides the feeder body into a base section having the passage opening and an along the central axis coaxial cap section, so that the feeder body is breakable in the weak section when a force is applied in the direction of the central axis, wherein the base section and the cap section are telescopically displaceable into one another section wise. Through this, a feeder insert of a telescope-type can be formed. The base section with the passage opening is fixedly arranged on the mold or the mold box. When molding sand is filled into the mold, the pressure on the feeder body increases so that the cap section, which is arranged vertically above the base section in a conventional orientation of the feeder insert, is pressed down. The feeder body breaks in the weak section and the cap section moves downward. In this case, either the base section can plunges into the cap section or the cap section plunges into the base section. In the simplest case, the base section plunges into the cap section. To this purpose, it is desirable that the base section has an outer diameter that is slightly smaller than or equal to an inner diameter of the cap section. The weak section may be formed as a section of reduced wall thickness, a section of multiple perforations, a clamp between separately formed base and cap sections, or otherwise frangible connection.

In a further embodiment, a metallic attachment having a collar extending in the direction of the central axis is arranged on the feeder body around the passage opening. Such a metallic attachment can also be referred to as a breaker core and serves to further constrict the metal at the point of attachment between the feeder insert and the mold. The collar reduces the attachment area of the feeder insert, which further facilitates placement of the feeder insert on a mold. The metallic attachment is further usable to secure the first and second feeder shells to each other. For this purpose, the metallic attachment preferably at least partially radially surrounds the first and second feeder shells to secure their connection.

It is further preferred that the first and second feeder shells are substantially identically formed. They may also be completely identically formed. By arranging the protrusions and recesses accordingly, it is possible to use identical parts and it is not necessary to provide two different molds to form the two feeder shells. In addition, assembly is simplified in this way.

By providing at least one recess as a receptacle for a centering pin tip on the feeder body, the positional stability or a desired alignment respectively of the feeder insert relative to a mold model or pattern plate accommodating the feeder insert can be maintained in a facilitated manner. Furthermore, by means of the recess provided on the feeder body, guidance of the feeder body or of the cap element is achieved during the compression process of the molding material forming the mold, during which the cap element is to be moved relative to the base element and thus also to the centering pin.

In a preferred further development, the centering pin recess has an insertion chamfer oriented toward the feeder cavity. This is particularly advantageous for feeder bodies designed as ball feeders. The insertion chamfer allows the centering pin to enter the recess more easily, and chipping or breaking away of material around the recess can be prevented. Chipped material could otherwise contaminate liquid metal to be received in the feeder, which can cause component quality to suffer. In particular, this facilitates robot-guided placement of the feeder insert.

According to a preferred further development of the invention, the feeder body at least section-wise comprises an exothermic heating mass. With the aid of such an exothermic heating mass, the solidification behavior of the liquid metal within the feeder cavity can be specifically influenced. The more exothermic mass the feeder body consists of or comprises, the longer the liquid metal in the feeder insert can be kept liquid by the exothermic heating mass and the longer the process of feeding into the casting is possible. Preferably, the feeder body is equipped with such an exothermic heating mass at certain points or section-wise.

Preferably, the feeder insert has a modulus in a range of about 0.5 cm to 9 cm, preferably from about 1.2 cm to 2.6 cm. The specified ratio of 0.5 cm to about 9 cm between volume and heat-emitting surface area preferably indicates the feeder inserts by means of which good seal feeding of a cast part to be produced can be achieved. In a preferred embodiment of the invention, the modulus of the feeder insert according to the invention lies in the range of about 1.2 to 2.6 cm.

In a further embodiment, the feeder insert comprises a metallic attachment which is arranged on the feeder body surrounding the passage opening and connects the first feeder shell and the second feeder shell to each other. The feeder shells can be held together only by the metallic attachment, or the metallic attachment is provided additionally. The metallic attachment is preferably formed from one piece, for example by deep drawing.

Preferably, the metallic attachment comprises at least one first latching element and the feeder body comprises at least one second latching element corresponding to the first latching element, such that the metallic attachment can be latched to the feeder body. For example, the metallic attachment comprises a projection that can positively engage a latching recess formed on the feeder body. Particularly preferably, the metallic attachment can be fastened to the feeder body in the manner of a bayonet catch.

According to a preferred embodiment, a feeder insert for use in metal casting in vertically separable casting molds is provided, wherein the feeder body is adapted for positioning by means of a centering pin positionable along a centering axis, and wherein the feeder cavity is configured such that a predominant volume portion of the feeder cavity is positionable above the centering axis when the centering axis is arranged horizontally. In a preferred embodiment, a corresponding feeder insert according to the invention can be used as a side feeder, with the aid of which, critical areas of the casting mold located in a side area of the casting mold can be refed instead of conventional density feeding on a casting mold, from its top side. According to a preferred embodiment of the inventive feeder insert, the feeder body is asymmetrical with respect to the central axis of the feeder body, which is defined by the passage opening on the feeder body or a centering pin projecting through the passage opening into the feeder cavity.

According to one embodiment of the inventive feeder insert, an asymmetrical design of the feeder cavity, with respect to the central axis of the feeder body is achieved by a non-uniform design of the feeder body on one side of the central axis. For a corresponding seal-feeding with such a feeder insert, the feeder insert is positioned with a preferred direction on a mold model or on a pattern plate. In a further embodiment the feeder body has an odd number of material webs on its inner side defining the feeder cavity, such that a larger number of material webs is arranged below the centering axis than above the centering axis when the centering axis is arranged horizontally.

In a further preferred embodiment, the feeder body is formed from exothermic feeder material or at least section-wise comprises exothermic feeder material. Alternatively or additionally, the feeder body is formed of insulating feeder material or at least section-wise comprises insulating feeder material. Alternatively or additionally, the feeder body is formed of or comprises a material selected from the group consisting of metals, plastics, paperboards, mixtures thereof, and composites thereof.

The use of exothermic feeder material achieves a high level of economy efficiency and, in particular, good seal-feeding during the casting process, since the metal in the feeder insert can be kept in the liquid state for a comparatively long period by the exothermic feeder material. However, a molding sand bonded with a binder, in particular quartz sand, can also be used as the feeder material. Frequently, however, an exothermic material is preferably used to form at least parts of the mold elements. Certain portions of the feeder insert may be formed of different materials having different properties (exothermic or insulating). Alternatively, the feeder body may be formed from a homogeneous mixture of materials with exothermic or insulating components.

Another aspect of the present invention relates to a method for producing a feeder core according to any of the preferred embodiments described above, comprising the steps of: shooting a first feeder shell in a core box; shooting a second feeder shell in the or a core box; and connecting the first and second feeder shells to form a feeder body. Shooting the first and second feeder shells in the or a core box may also occur simultaneously or substantially simultaneously. The first and second feeder shells may also be formed in the same shot mold one after the other or sequentially respectively. This is particularly preferred when the first and second feeder shells are formed substantially identical. As described above, connecting the first and second feeder shells to form the feeder body can be carried out both by positive-locking and by substance-to-substance-jointing.

The method preferably further comprises the step of: forming at least a first protrusion on the first feeder shell by not or not completely removing a material appendix formed by an inlet opening of the core box. It may be provided that the material appendix is partially removed or partially or fully smoothed in order to form the protrusion. Alternatively, a protrusion may be separately and additionally formed on the feeder shell.

It is further preferred that the method comprises: Arranging a holding sleeve circumferentially about the first and second feeder shells. On the one hand, arranging the holding sleeve may comprise putting an already formed holding sleeve over the feeder body approximately coaxially with the central axis. In this respect, the step of arranging a holding sleeve circumferentially about the first and second feeder shells preferably also comprises the step of: fabricating or providing a holding sleeve. As described above, the holding sleeve may be formed of various materials. However, the step of arranging the holding sleeve circumferentially about the first and second feeder shells may also comprise manufacturing the holding sleeve. For example, it is conceivable and preferred that a strip of paper is wrapped around the first and second feeder shells that are already connected to each other, and that the holding sleeve is fabricated in this manner when the holding sleeve is arranged around the first and second feeder shells. In this case, arranging the holding sleeve about the first and second feeder shells includes wrapping a material around the first and second feeder shells and thus around the central axis.

In a further embodiment, connecting the first and second feeder shells comprises inserting a pin into at least one pin receptacle, the pin preferably being formed from molding compound, metal, plastic or paper or cardboard respectively. The pin is preferably formed such that it can be inserted into molded holes or pin receptacles and thus firmly connects the two feeder shells to one another after pressing. Multiple pins may be provided as well.

Embodiments of the invention are now described below with reference to the drawings. These are not necessarily intended to show the embodiments to scale; rather, where useful for explanation, the drawings are in schematized and/or slightly distorted form. With regard to additions to the teachings directly recognizable from the drawings, reference is made to the relevant prior art. It should be understood that various modifications and changes concerning the shape and detail of an embodiment can be made without departing from the spirit of the invention. The features of the invention disclosed in the description, in the drawings as well as in the claims may be essential for the further development of the invention considered alone or in combination. Further, all combinations of at least two of the features disclosed in the description, the drawings and/or the claims fall within the scope of the invention. The invention is not limited to the exact form or detail of the preferred embodiments shown and described below, or limited to any subject matter that would be limited as compared to the subject matter of the claims. In the case of specific ranges, values within the specified limits are also intended to be disclosed as limiting values and to be capable of being used and claimed as desired. For the sake of simplicity, identical reference signs are used below for identical or similar parts or parts with identical or similar function.

Figure 2:
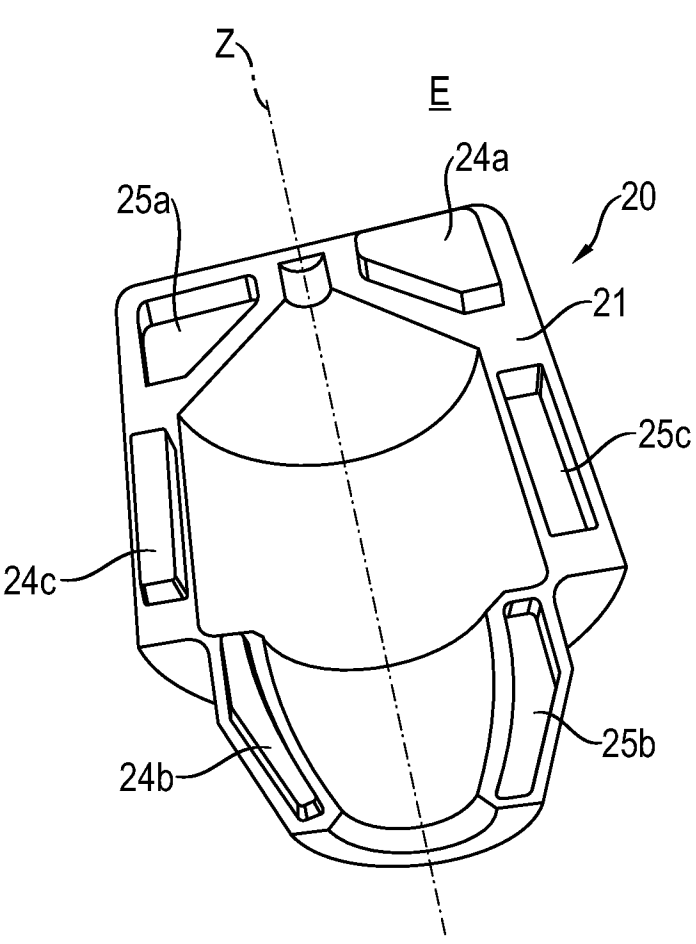
Figure 2:
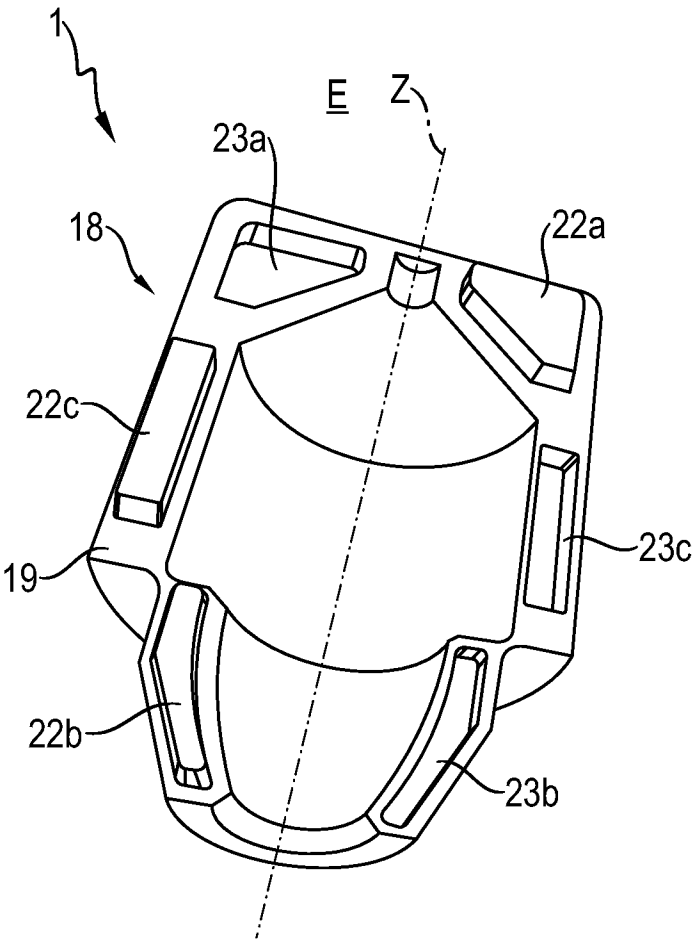
Figure 3A:
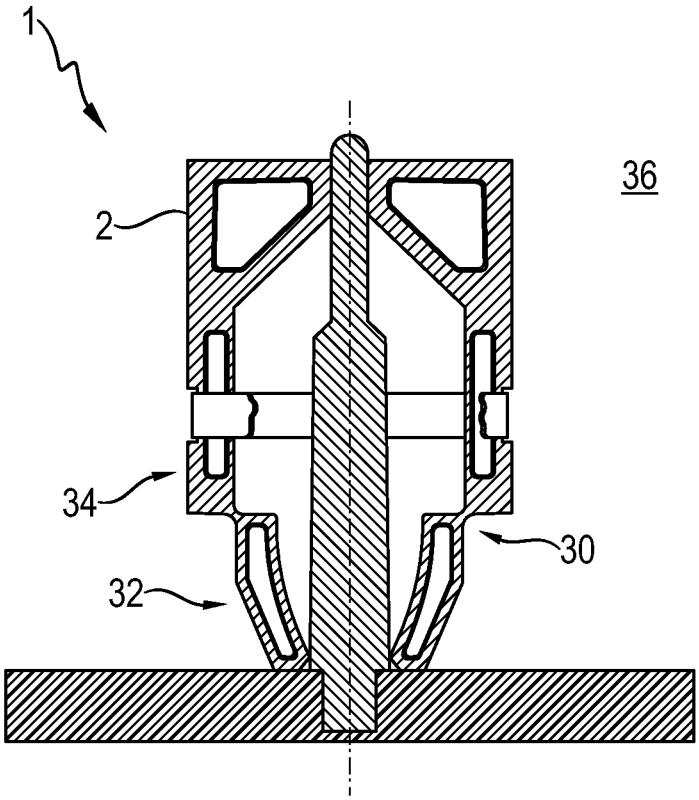
Figure 3B:
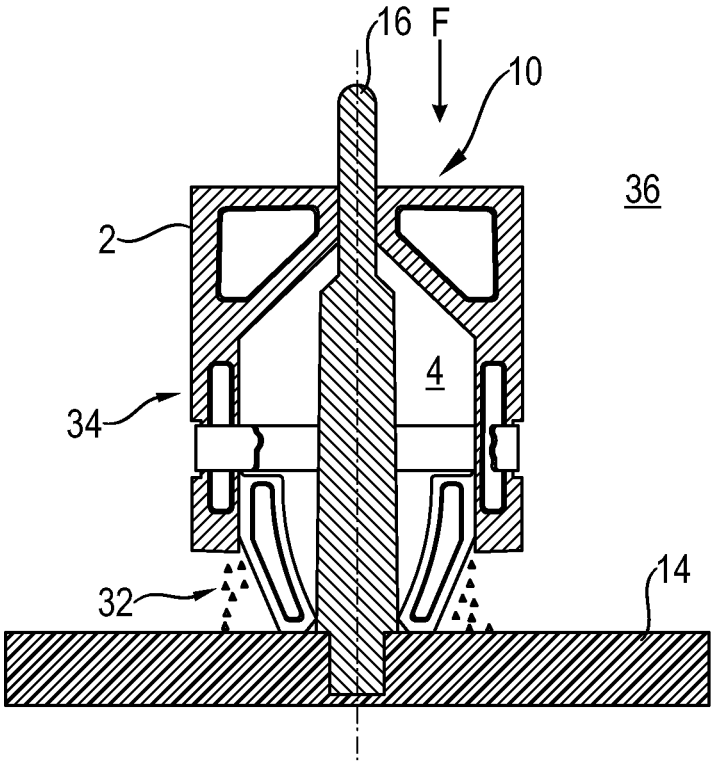
Figure 4B:
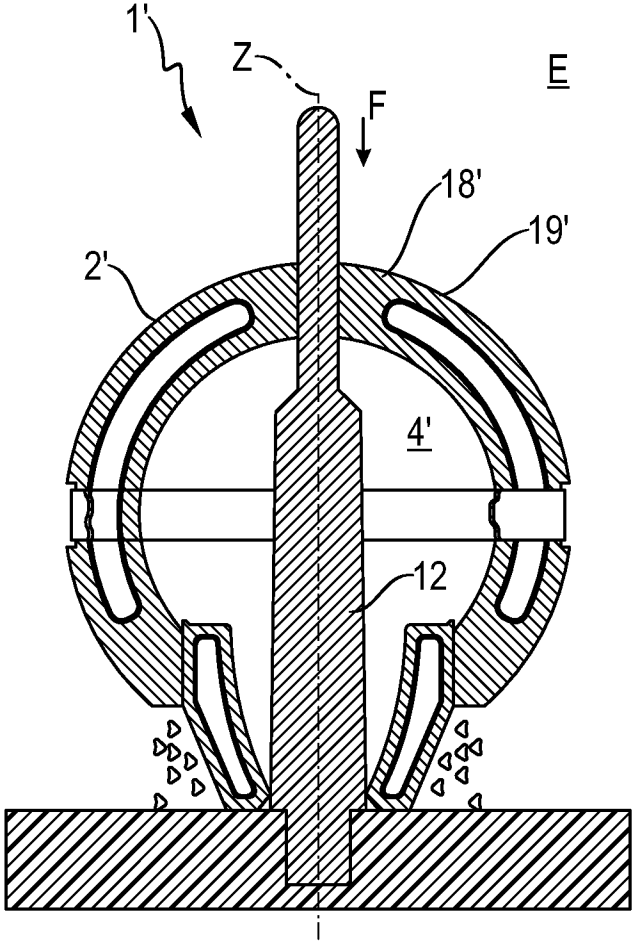
Figure 4A:
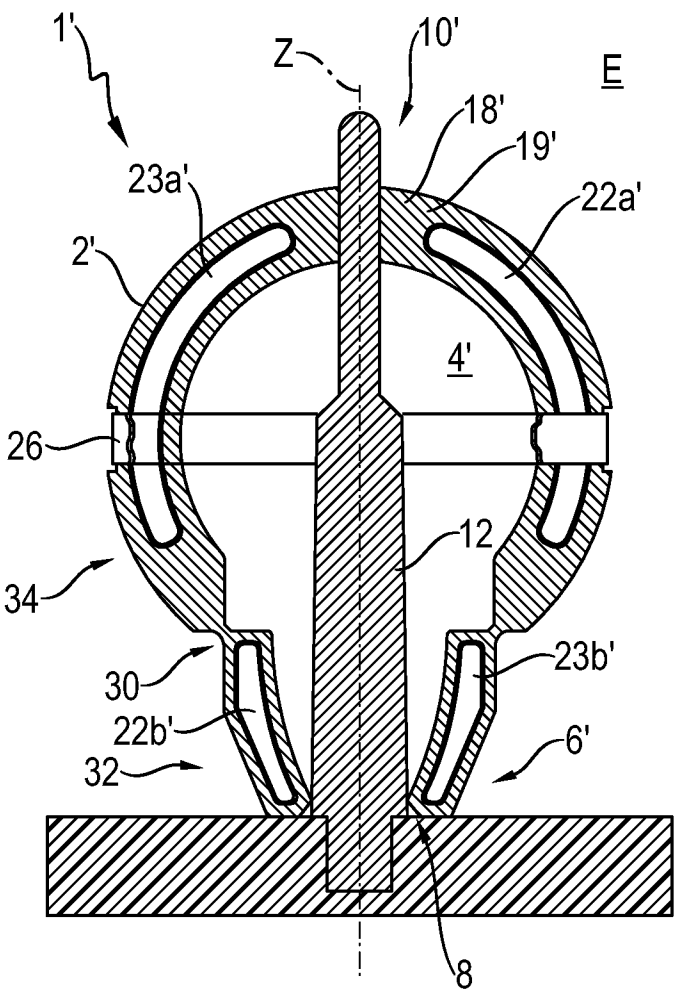
Figure 5B:
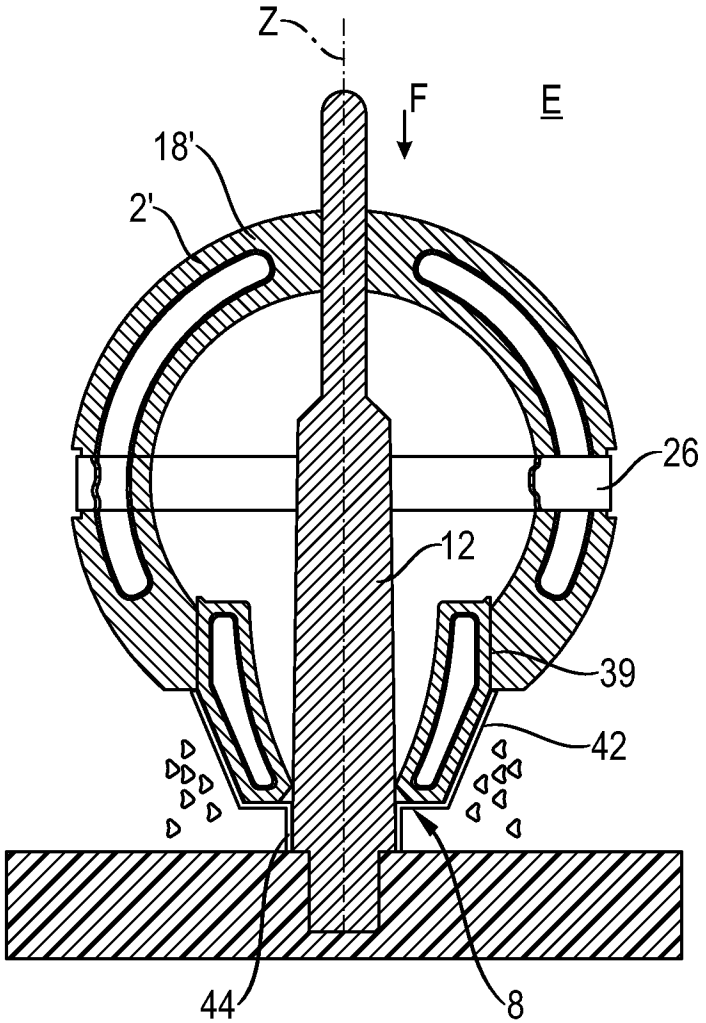
Figure 5A:
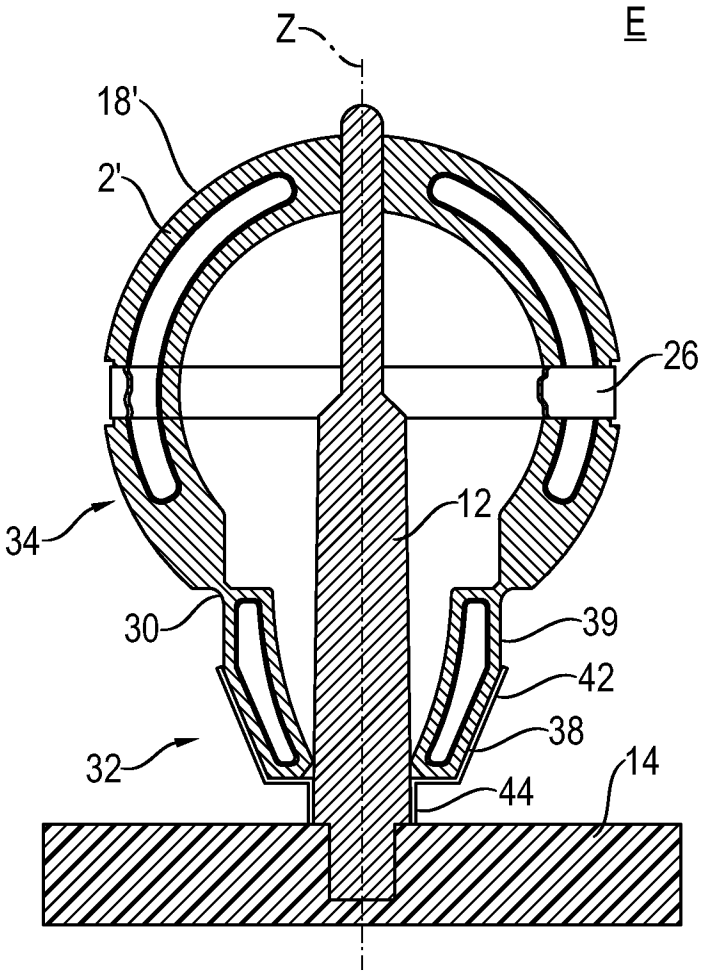
Figure 6B:
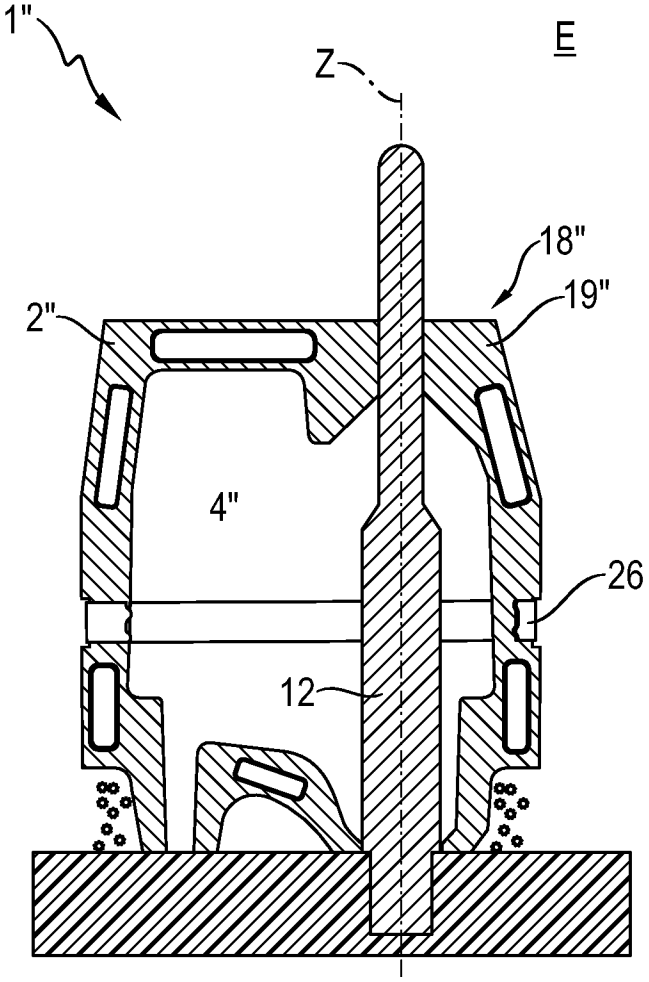
Figure 6A:
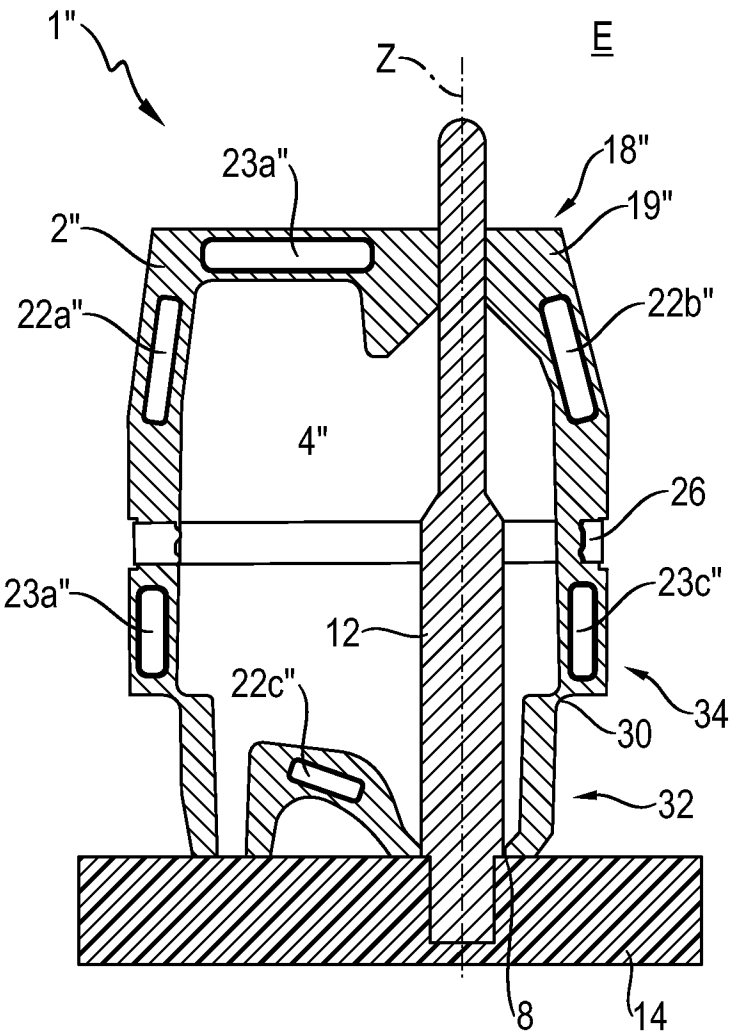
Figure 7:
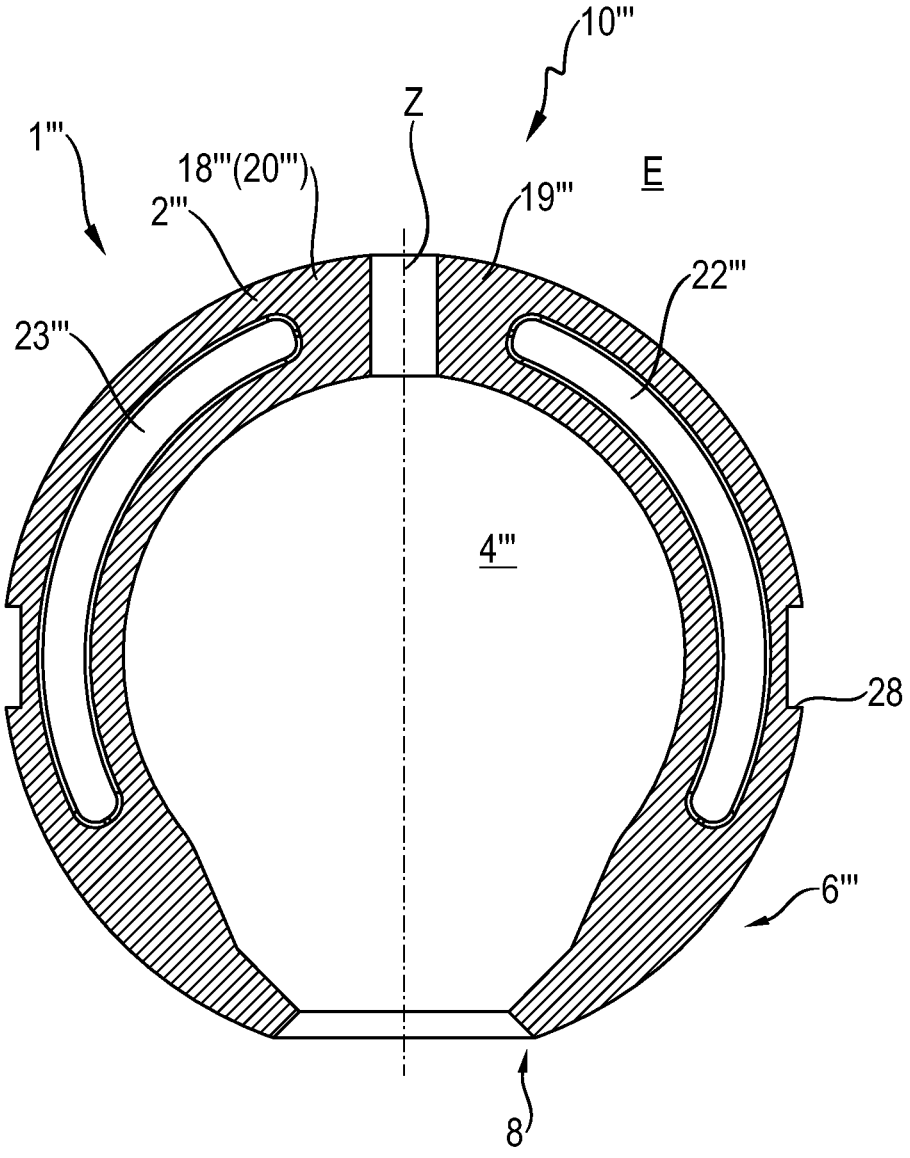
Figure 8:
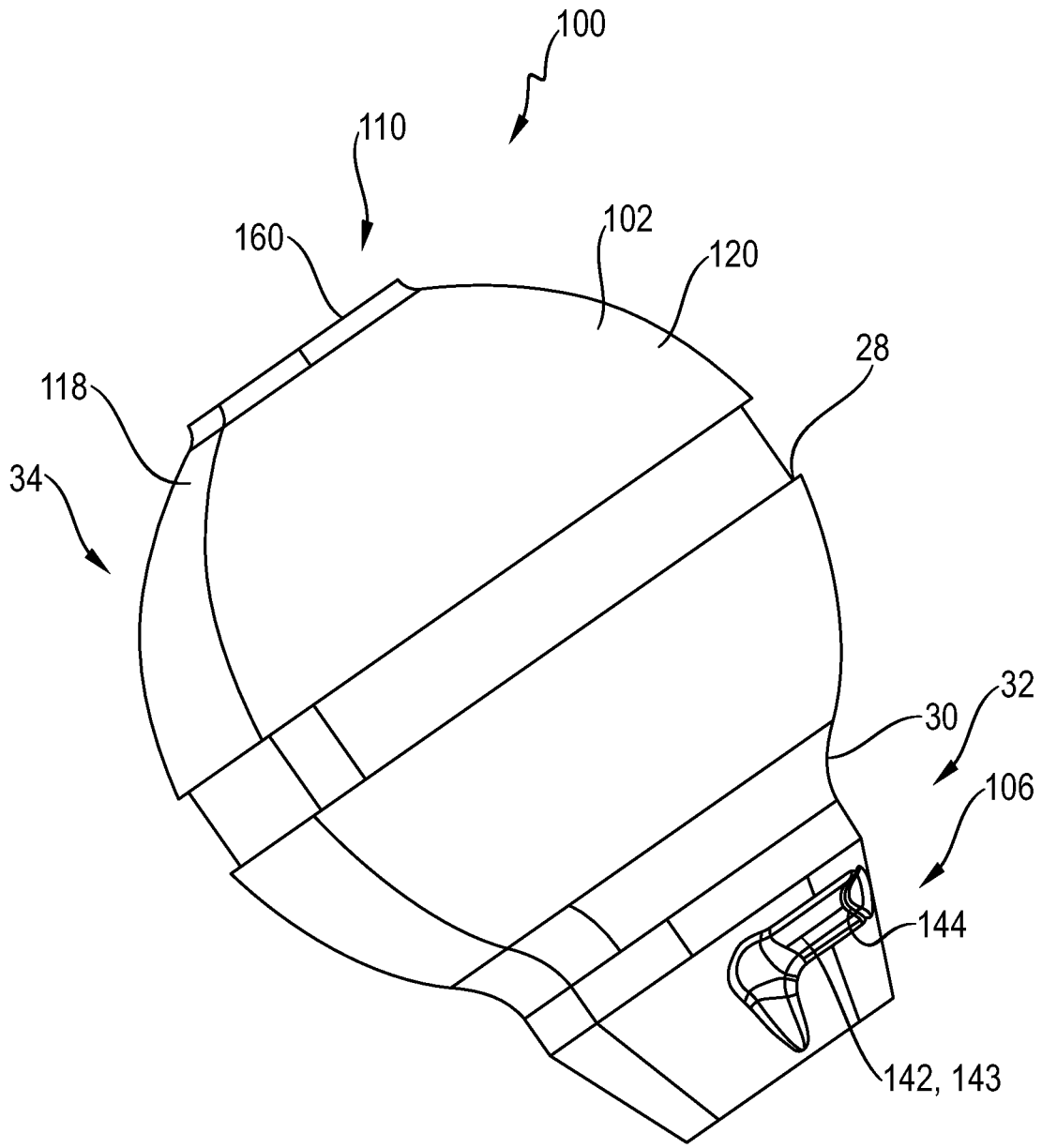
Figure 9:
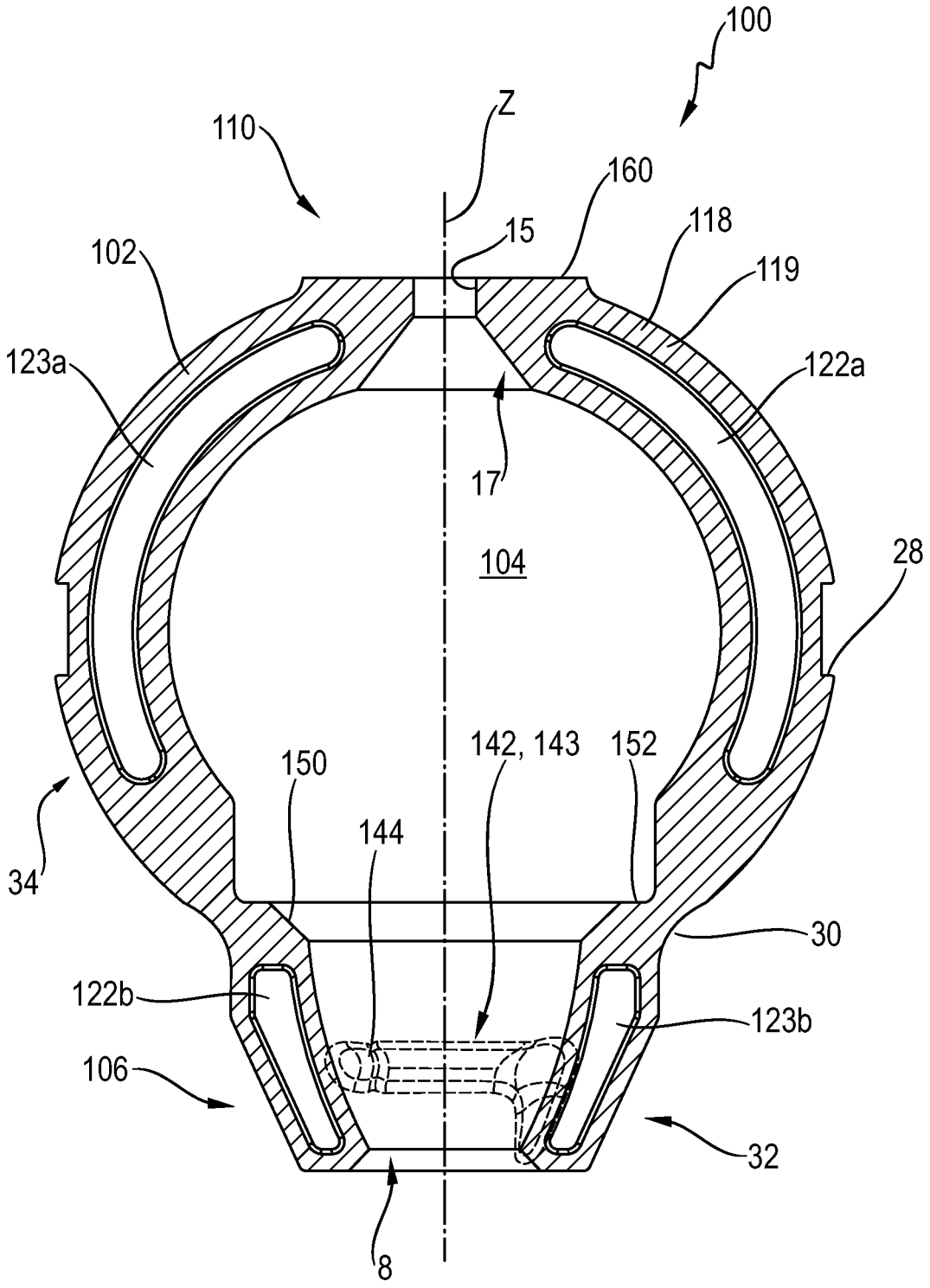
Figure 10A:
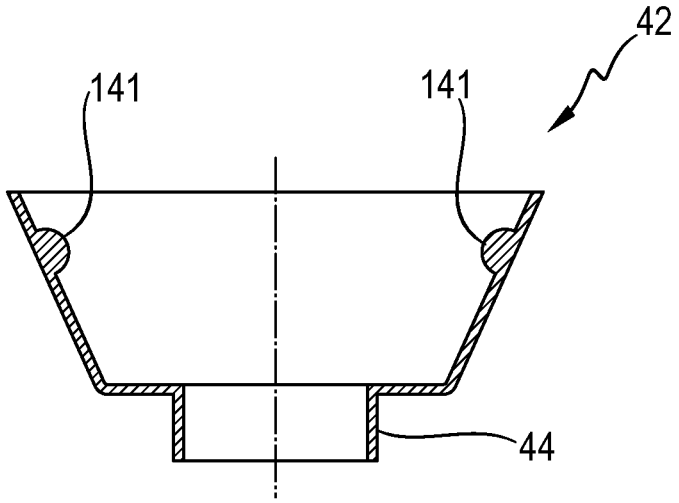
Figure 10B:
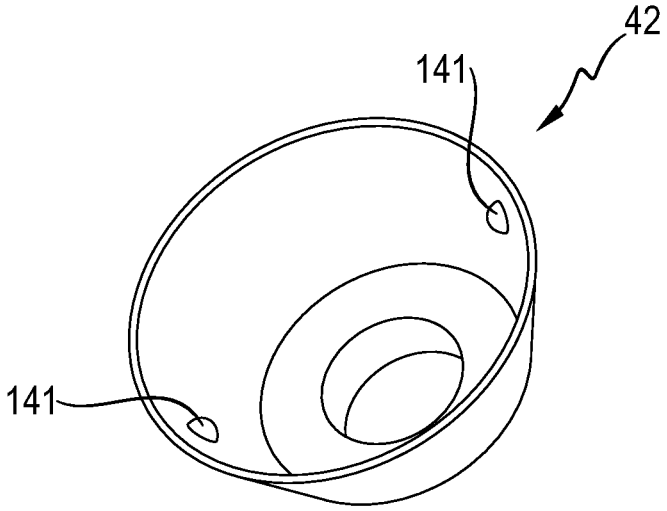
Figure 11:
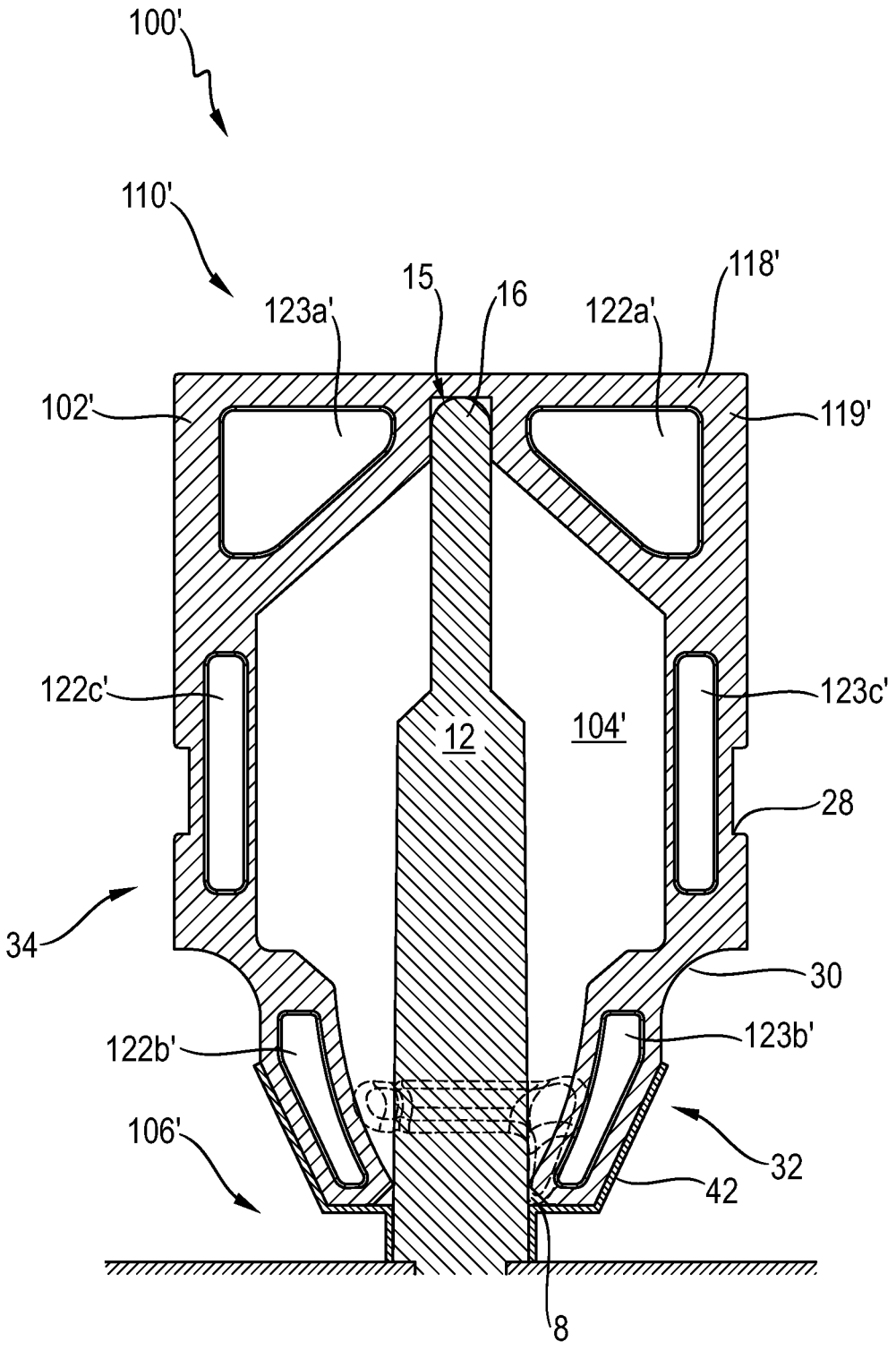

Further advantages, features and details of the invention will be apparent from the following description of the preferred embodiments and from the drawings; which show in:

FIG. 1 a section through a feeder insert according to a first embodiment;

FIG. 2 a perspective view of two feeder shells of the first embodiment;

FIG. 3*a* a sectional view of the feeder insert according to FIG. 1 in an uncompressed state;

FIG. 3*b* a sectional view of the feeder insert according to FIG. 1 in a compressed state;

FIG. 4*a* a sectional view of a feeder insert according to a second embodiment in an uncompressed state;

FIG. 4*b* a view of the feeder insert according to FIG. 4*a* in a compressed state;

FIG. 5*a* a sectional view of a feeder insert according to a third embodiment in an uncompressed state;

FIG. 5*b* a sectional view of the feeder insert according to FIG. 5*a* in a compressed state;

FIG. 6*a* a sectional view of a feeder insert according to a fourth embodiment in an uncompressed state;

FIG. 6*b* a sectional view of the feeder insert according to FIG. 6*a* in a compressed state;

FIG. 7 a sectional view of a feeder insert according to a fifth embodiment;

FIG. 8 a perspective view of a feeder insert according to a sixth embodiment;

FIG. 9 a sectional view of the feeder insert according to FIG. 8;

FIG. 10*a* a sectional view of a metallic attachment for use with the feeder insert of the sixth embodiment;

FIG. 10*b* a perspective view of the metal attachment of FIG. 10*a*; and in FIG. 11 a sectional view of a feeder insert according to a seventh embodiment.

FIG. 1 shows a first embodiment of a feeder insert 1 according to the invention, used in metal casting of metals in a casting mold not shown in more detail. The feeder insert 1 comprises a feeder body 2, which defines a feeder cavity 4 for receiving liquid metal. The feeder body 2 has a first end 6 with a passage opening 8 for the liquid metal. The feeder body 2 further comprises a second end 10 opposite the first end 6, the second end 10 of the feeder body 2 being closed.

In the embodiment shown in FIG. 1, a centering pin 12, which is arranged on a pattern plate 14 or a form model, is inserted in the feeder body 2. The centering pin 12 serves to ensure the exact position of the feeder insert 1. However, the centering pin 12 is not part of the feeder insert 1 itself, but merely serves to position the feeder insert 1 during mold production and is removed after production of at least one mold part of the casting mold. In the example embodiment shown in FIG. 1, a centering tip 16 of the centering pin 12 extends through the second end 10 of the feeder body 2. However, this is not absolutely necessary and the centering pin 12 with its centering tip 16 can also end inside the feeder body 2.

The feeder body 2 further comprises a central axis Z, which in FIG. 1 extends vertically and centrally extends through the passage opening 8. In the feeder insert 1 according to FIG. 1, the central axis Z further coincides with a centering axis of the centering pin 12. The feeder insert 1 is divided along a partition plane E, which in FIG. 1 extends in the image plane and is thus parallel to and includes the central axis Z. The feeder body 2 is formed from a first feeder shell 18 and a second feeder shell 20 (cf. FIG. 2), which can be or are connected to one another to form the feeder body 2. Since the sectional plane according to the drawing of FIG. 1 also lies in the image plane, only the first feeder shell is visible in FIG. 1. FIG. 2, on the other hand, shows a disassembled feeder insert 1, in which the first and second feeder shells 18, 20 can be seen.

The feeder insert 1 or the feeder body 2 respectively is split vertically and each of the feeder shells 18, 20 can be produced separately. In this way, even such complex shapes as shown in FIG. 1 can be produced in a simplified manner. The feeder cavity 4 of the example embodiment shown in FIG. 1 comprises an undercut, which is characterized by the fact that starting from the passage opening 8 the feeder cavity 4 first widens and then tapers again in the direction of the second end 10. In order to be able to produce such a feeder cavity 4 with a one-piece feeder body 2, it would be necessary to use a lost core in the interior. Alternatively, such a feeder cavity 4 would have to be fabricated using lift-off manufacturing techniques. In the prior art, such a mold has typically been formed by dividing the feeder body 2 horizontally, namely consisting of a lower feeder part and an upper feeder part, which can be separated from each other in the vertical direction. Nevertheless, there are limitations in the geometry with the conventional method of operation which are no longer present due to the present vertical division.

The first feeder shell 18 has a first partition surface 19 and the second feeder shell 20 has a second partition surface 21. The first and second partition surfaces 19, 21 are configured to abut each other when the feeder shells 18, 20 are assembled together. Three protrusions are provided on the first partition surface 19 of the first feeder shell 18, namely a first protrusion 22*a*, another first protrusion 22*b* and a third first protrusion 22*c*. In addition, the first partition surface 19 of the first feeder shell 18 further comprises a first recess 23*a*, another first recess 23*b*, and a third first recess 23*c*. The second feeder shell 20 or also the second partition surface 21 respectively corresponds with the first feeder shell 18 or the first partition surface 19 and has a second protrusion 24*a*, a further second protrusion 24*b* as well as a third second protrusion 24*c*. It further comprises a second recess 25*a*, a further second recess 25*b*, and a third second recess 25*c*. As can be readily seen from FIG. 2, the protrusions and recesses of the two feeder shells 18, 20 can cooperate with each other. When joining the two feeder shells 18, 20, the first protrusion 22*a* engages the second recess 25*a* and the second protrusion 24*a* engages into the first recess 23*a*. The same applies to the remaining recesses and protrusions. Thus, the protrusion 22*c* engages the recess 25*c*, the protrusion 24*c* engages the recess 23*c*, the protrusion 22*b* engages the recess 25*b*, and the protrusion 24*b* engages the recess 23*b*.

The first and second feeder shells 18, 20 of the first embodiment (FIGS. 1-3*b*) are further characterized in that the feeder shells 18, 20 are identically formed. This can be realized by the skillful arrangement of the protrusions and recesses. As a result, identical parts can be used and the feeder shells 18, 20 can be manufactured in the same core shooting machine.

The protrusions 22*a*-22*c*, 24*a*-24*c* and recesses 23*a*-23*c*, 25*a*-25*c* act together as positive locking elements by means of which the first and second feeder shells 18, 20 can be joined together. In the example embodiment shown in FIG. 1, a retaining collar 26 is further provided in order to maintain the joined position of the first and second feeder shells 18, 20. The retaining collar 26 is received in a circumferential recess 28 to fix axial position of the retaining collar 26. However, this recess 28 is not essential and is not provided in the example embodiment shown in FIG. 2. For example, the retaining collar 26 may be formed of paper, rubber, elastomeric material, metal or other materials. The retaining collar 26 must not withstand particularly high forces, rather it serves to prevent the first and second feeder shells 18, 20 from falling apart during transport or positioning on the pattern plate 14. Preferably, the holding sleeve 26 is formed of a material which combusts residue-free during the casting process. In this way, the molding sand surrounding the feeder insert 1 can be kept free of residues of other materials.

The various protrusions 22*a*-22*c*, 24*a*-24*c* and recesses 23*a*-23*c*, 25*a*-25*c* are arranged on the first and second partition surfaces 19, 21 such that a distance A between adjacent ones of these elements (cf. FIG. 1) is not greater than a predetermined value, namely preferably not greater than 20 mm. The shorter this distance is, the better, in order to avoid so-called fins. As can easily be inferred from FIGS. 1 and 2, liquid metal entering the feeder cavity 4 through the passage opening 8 could flow between the partition surfaces 19, 21 and there through towards the outside of the feeder insert 1. Interlocking of the projections and recesses, however, forms a certain barrier. On the one hand, this is advantageous in order to prevent heat transport from the feeder cavity 4 to the outside, and on the other hand, it is also advantageous in order to interrupt material flow and thus ensure that no fins are formed, namely solidified metal, which remains between the first and second partition surfaces 19, 21 in planar form. The shorter these surfaces are, the better for the casting process. Likewise, it is preferred if the interlocking elements, i.e. the protrusions and recesses, occupy as large an area as possible. As can be inferred from FIGS. 1 and 2, the free area, i.e. an area without a protrusion or recess, of the first and second partition surfaces 19, 21 in the axial direction, i.e. seen along the central axis Z, is relatively small, preferably less than 50% measured with respect to the overall length of the feeder body 2. This also leads to increased insulation and prevents the formation of fins.

Furthermore, the feeder insert 1 according to the present example embodiment is formed as a so-called tele-feeder and comprises a weak section 30 at which the feeder body 2 can be broken and compressed. This is shown in particular with reference to FIGS. 3*a*, 3*b*. Therefore, the feeder body 2 comprises a base portion 32 and a cap portion 34, which are separated from each other by the weak section 30. The weak section 30 is formed as a section with reduced wall thickness, as can be readily inferred from FIGS. 1-3*b*. The base portion 32 has a first outer diameter D1 which is equal to or smaller than a second diameter D2, namely the inner diameter of the feeder cavity 4 in the area of the cap portion 34. In this way, when the weak section 30 breaks, the base portion 32 can dip into the cap portion 34.

When the feeder insert 1 is encased in molding sand 36, as shown in FIG. 3*a*, and this molding sand 36 is then compressed, as shown in FIG. 3*b*, a force F acts in particular on the second end 10 of the feeder body 2 so that the centering tip 16 pushes through the second end 10 and the cap portion 34 moves downward toward the base portion 32. Since the base portion 32 is fixed (namely in contact with the pattern plate 14), the material of the feeder body 2 breaks in the region of the weak section 30 and the cap portion 34 is pushed over the base portion 32. As a result, the volume of the feeder cavity 4 is reduced.

The base portion 32 is also slightly conical in shape. It tapers toward the passage opening 8 both on its exterior 38 and on its inner surface 40. In this way, a constriction can be formed so that solidified metal located in the feeder cavity 4 after completion of the casting process can be knocked off easily. The taper serves to create a notch with a notch effect. In addition, the taper, in particular the taper on the exterior 38, provides a smaller footprint for the feeder insert 1.

Although the example embodiment shown in FIG. 1 shows weak section 30, it is to be understood that such a feeder insert 1 having a tapered base portion 32 is also preferred and is disclosed herein when no weak section 30 is provided.

FIGS. 4*a*, 4*b* show a second embodiment of the present invention. Again, the feeder insert 1' has a feeder body 2' which defines a feeder cavity 4' for receiving liquid metal. Identical and similar elements are indicated by reference signs, with an apostrophe for the second example embodiment. In particular, the differences with respect to the first example embodiment are highlighted below.

A major difference from the first embodiment is that the feeder cavity 4' is formed part-spherical. The feeder body 2' is again formed from two feeder shells 18', 20', of which, only one feeder shell 18' is shown in FIGS. 4*a*, 4*b*. However, the second feeder shell 20' is again formed identically to the first feeder shell 18'. This can be easily seen from the first protrusion 22*a*', the further first protrusion 22*b*' and the first recess 23*a*' and the further first recess 23*b*'.

The geometry of the feeder body 2' differs from that of the first embodiment (FIGS. 1-3*b*) in particular in that the cap portion 34 of the feeder body 2' is also formed substantially part-spherical. In this respect, the first protrusion 22*a*' and the first recess 23*a*' are also formed in a part-circular or arched. The feeder insert 1' according to the second example embodiment (FIGS. 4*a*, 4*b*) is also formed as a tele-feeder and has a weak section 30 whose function corresponds to that of the first example embodiment (FIGS. 1-3*b*).

A spherical shape is a particularly preferred, since a sphere has a particularly preferred surface area to volume ratio. In this way, the temperature of the metal received in the feeder cavity 4 can be kept high and it remains liquid for a longer time than in other geometries.

The feeder body 2' of the second embodiment (FIGS. 4*a*-4*b*) also comprises an undercut, and starting from the passage opening 8 in the direction of the second end 10' the feeder cavity 4' initially widens along the central axis Z and then tapers again. For feeders, the spherical shape is particularly complex to manufacture and is particularly preferred in the context of the invention as it can be manufactured easily and economically due to the two feeder shells 18', 20'.

A third embodiment shown in FIGS. 5*a*, 5*b* is essentially based on the second embodiment shown in FIGS. 4*a* and 4*b*, so that in particular the differences from the second embodiment (FIGS. 4*a*, 4*b*) are highlighted below.

In contrast to the second embodiment (FIGS. 4*a*, 4*b*), a metallic attachment 42 is provided in the third embodiment (FIGS. 5*a*, 5*b*), which is arranged around the passage opening 8 and has a collar 44 extending axially in the direction of the central axis Z. In the embodiment shown here, the metallic attachment 42 covers the conical area of the exterior 38, but not a cylindrical section 39 with the first diameter D1. As described in principle above, the cylindrical section 39 is intended to plunge into the cap portion 34 of the feeder body 2' when the weak section 30 breaks (as shown in FIG. 5*b*), so that it is advantageous if the metallic attachment 42 is not arranged here.

The protruding collar 44 serves to space the feeder body 2' somewhat apart from the pattern plate 14 and at the same time to reduce the contact area. Here, the inner diameter of the collar 44 corresponds essentially to the outer diameter of the centering pin 12. In all other respects, the feeder body 2' corresponds to that of the third embodiment (FIGS. 4*a*, 4*b*). The metallic attachment 42, which is preferably a single piece, surrounds, preferably completely surrounds, the conical section of the base section 42 radially, and in this way leads to a further fixation of the two feeder shells 18', 20' and therefore supports the function of the retaining collar 26.

FIGS. 6*a*, 6*b* show a so-called side feeder which is used to be attached to the side of a casting mold. For such a side feeder, the first and second feeder shells 18", 20" cannot be formed identically, as was the case in the previous example embodiments, which can readily inferred from FIGS. 6*a*, 6*b*. Rather, the feeder shells 18", 20" must be formed substantially mirror symmetrical along the partition plane E, and protrusions and recesses should each be complementary to one another. In the example embodiment shown in FIGS. 6*a*, 6*b*, the first feeder shell 18" again has a first partition surface 19" on which a first protrusion 22*a*", a further first protrusion 22*b*" and a third first protrusion 22*c*" are formed. These are arranged alternately with a first recess 23*a*", a further first recess 23*b*" and a third first recess 23*c*" following a clockwise or counterclockwise direction. The alternating arrangement of protrusion and recess results in a better connection of the first and second feeder shells 18", 20". A retaining collar 26 is provided in the example embodiment shown here as well, although this is not absolutely necessary, and the feeder shells 18", 20" can also be connected with a substance-to-substance bond, for example, by means of an adhesive.

In this case, the feeder insert 1", which is formed as a side feeder, is also formed as a so-called tele-feeder. It also comprises a weakened area 30 as well as a base portion 32 and a cap portion 34, whereby an outer diameter of the base portion 32 is smaller than or equal to the inner diameter of the cap portion 34. FIG. 6*b* shows a compressed form in which the cap portion 34 has been moved downward relative to the base portion 32 and the weakened area 30 is already broken. Furthermore, a centering pin 12 is also provided in this example embodiment, which again serves to hold the feeder insert 1" formed as a side feeder, to the pattern plate 14.

As can be inferred from FIGS. 6*a*, 6*b*, the geometry of the feeder cavity 4" is very complex. By dividing the feeder body 2" according to the invention into the first feeder shell 18" and the second feeder shell 20" along a partition plane E which is parallel to or contains the central axis Z, this complex geometry can be produced easily and at low cost.

FIG. 7 now shows a feeder insert 1''' according to a fifth embodiment. This feeder insert 1''' is essentially oriented on the feeder insert according to the second and third example embodiments (FIGS. 4*a* to 5*b*), whereby in contrast to the second and third example embodiments, the feeder insert 1''' according to the fifth example embodiment is not formed as a tele-feeder. For this reason, it does not have a base portion, but only a feeder body 2''', which essentially corresponds to the cap portion according to the second and third example embodiments. Nevertheless, it has the other features according to the invention, such as in particular the central axis Z, a first and second feeder shell 18''', 20''' (only the feeder shell 18''' shown in FIG. 7), comprising a first partition surface 19''' with a protrusion 22''' and a recess 23'''. It may be referred to as a spherical feeder and has a spherical or part-spherical feeder cavity 4'''. The first and second feeder shells 18''', 20''' according to the fifth embodiment may again be identical to each other. Also, a recess 28 is provided for a holding sleeve (not shown). For the remaining features, reference is made to the previous embodiments.

In FIGS. 8 to 11, reference signs are provided with numbers added by 100. When the same reference signs as in the previous embodiments are used, the same elements as in the first embodiments are designated, and in this respect full reference is made to the above description.

FIGS. 8 and 9 first illustrate a sixth example embodiment based on the example embodiment according to FIGS. 5*a*, 5*b*. In the following it will be referred to this in full and essentially the differences will be described.

A first difference from the example embodiment of FIGS. 5*a*, 5*b* is that the feeder body 102 according to FIGS. 8 and 9 is configured to cooperate with the metallic attachment 42 as shown in FIGS. 10*a*, 10*b*. In the example embodiment shown in FIGS. 10*a*, 10*b*, the metallic attachment 42 has first latching elements 141, which are here formed as projections or lugs. These can be provided directly during the manufacturing process of deep drawing the metallic attachment 42. The feeder body 102 comprises corresponding second latching elements 142, here in the form of an L-shaped groove 143. The first latching element 141 of the metallic attachment 42 can cooperate with this in the manner of a bayonet catch. The metallic attachment 42 is first placed onto the assembled feeder shells 118, 120 axially from below, with the first latching elements 141 entering the sections of the groove 143 that are aligned parallel to the central axis Z. The first latching elements 141 of the metallic attachment 42 are then inserted into the groove 143. Subsequently, the metallic attachment 42 is to be rotated about the central axis Z, clockwise with respect to the example embodiment shown. Preferably, a constriction 144 is provided in the groove 143 to narrow the cross-section before of a frontal end of the groove 143. The first latching element 141 can then be pushed over the constriction 144, using force, and move behind it in the movement direction, so that the metallic attachment 42 is secured against reverse rotation. In this way, it cannot be lost during transport.

The same type of connection between the metallic attachment 42 and the feeder body 102, 102' is also provided in the example embodiment of FIG. 11.

Another difference in the sixth embodiment (FIGS. 8, 9) is that an insertion chamfer 17 is provided on the recess 15 for the centering pin tip 16. This ensures that the tip does not bluntly hits against the ceiling of the feeder cavity 104 and breaks out material when the feeder insert 100 is placed on a centering pin 12. The material of the feeder body 102 is preferably exothermic material, and fragments thereof may contaminate molten metal entering the feeder cavity 104, which may result in degraded component quality. Therefore, the preferred insertion chamfer serves to improve the quality of a casted component.

According to the embodiment shown herein, a chamfer 150 is further provided in the lower region of the feeder body 102, specifically at the base portion 32. It has been shown in experiments that in embodiments as shown in FIGS. 4*a* to 5*b*, which do not have such a chamfer, material breaking out of the ceiling may remain on the annular shoulder 152 of the base portion 32. As described above, this material may then adversely affect component quality in the subsequent casting process. The chamfer 150 allows material that may break away to fall down towards the passage opening 8, so that it can be removed from the feeder cavity 104 when the centering pin 12 is withdrawn. Therefore, the chamfer 150 also serves to improve component quality.

Furthermore, it is provided in the sixth example embodiment of FIGS. 8, 9 that a region of the cap portion 34, opposite the passage opening 8, is flattened and has a planar surface 160. The planar surface 160 allows setting down the feeder insert 100 during transport. This simplifies transport and handling.

FIG. 11 shows a seventh example embodiment based on the example embodiment of FIGS. 3*a*, 3*b*, but additionally using the metallic attachment 42 shown in FIGS. 10*a*, 10*b*. For the detailed description and advantages, reference is made to the above.

LIST OF REFERENCE SIGNS

1, 1', 1", 1''', 100, 100' feeder insert
2, 2', 2", 2''', 102, 102' feeder body
4, 4', 4", 4''', 104, 104' feeder cavity
6, 6', 6", 6''', 106, 106' first end
8 passage opening
10, 10', 10", 10''', 110' second end
12 centering pin
15 recess for centering pin tip
16 centering pin tip
17 insertion chamfer
18, 18', 18", 18''', 118 feeder shell
19, 19', 19", 19''', 119 first partition surface
20, 20', 20", 120 second feeder shell
21, 21', 21", 21''', 121 second partition surface
22*a*-22*c* first protrusions
23*a*-23*c* first recesses
24*a*-24*c* second protrusions
25*a*-25*c* second recesses
26 holding sleeve
28 recess for holding sleeve
30 weak section
32 base portion
34 cap portion
36 molding sand
38 exterior
39 cylindrical section
40 inner surface
42 metallic attachment
44 collar
141 first latching element
142 second latching element
143 L shaped groove
144 constriction
150 chamfer
152 annular shoulder
160 plane surface
A distance
D1 first diameter
D2 second diameter
E partition plane
Z central axis

We claim:

1. A feeder insert (1, 1', 1", 1''', 100, 100') for use in metal casting in casting molds, having a feeder body (2, 2', 2", 2''', 102, 102') which delimits a feeder cavity (4, 4', 4", 4''', 104, 104') for receiving liquid metal, wherein the feeder body (2, 2', 2", 2''', 102, 102') has a first end (6, 6', 6", 6''', 106, 106') with a passage opening (8) for the liquid metal and a second end (10, 10', 10", 10''', 110, 110') opposite to the first end (6, 6', 6", 106, 106'), and wherein the feeder body (2, 2', 2", 2''', 102, 102') comprises a central axis (Z) extending through the passage opening (8), wherein the feeder body (2, 2', 2", 2''', 102, 102') is separated at least one partition plane (E) extending in a direction of the central axis (Z) and is formed from at least a first feeder shell (18, 18', 18", 18''', 118, 118') and a second feeder shell (20, 20', 20", 20''', 120, 120'), wherein the first and second feeder shells (18, 18', 18", 18''', 118, 118') are connected to each other to form the feeder body (2, 2', 2", 2''', 102, 102'), and a holding sleeve (26) partially or completely circumferentially surrounds the feeder body (2, 2', 2", 2''', 102, 102') for holding the first and second feeder shells (18, 18', 18", 18''', 118, 118', 20, 20', 20", 120, 120') together.

2. The feeder insert of claim 1, wherein the first feeder shell (18, 18', 18", 18''', 118, 118') comprises a first partition surface (19, 19', 19", 19''', 119, 119') and the second feeder shell (20, 20', 20", 120, 120') comprises a second partition surface (21, 21', 21", 21''', 121, 121') corresponding to the first partition surface (19, 19', 19", 19''', 119, 119') for connecting the first and second feeder shells (18, 18', 18", 18''', 118, 118', 20, 20", 20''', 120, 120') to each other.

3. The feeder insert of claim 1, wherein the first feeder shell (18, 18', 18", 18''', 118, 118') comprises at least one first protrusion (22*a*, 22*b*, 22*c*, 22*a'*, 22*b'*, 22*a"*, 22*b"*, 22*c"*, 22''', 122*a*, 122*b*, 122*c*, 122*a'*, 122*b'*, 122*c'*) and at least one first recess (23*a*, 23*b*, 23*c*, 23*a'*, 23*b'*, 23*a"*, 23*b"*, 23*c"*, 23''', 123*a*, 123*b*, 123*c*, 123*a'*, 123*b'*, 123*c'*) and wherein the second feeder shell (20, 20', 20", 20''', 120, 120') comprises at least one second protrusion (24*a*, 24*b*, 24*c*) and a second recess (25*a*, 25*b*, 25*c*), wherein the first protrusion (22*a*, 22*b*, 22*c*, 22*a'*, 22*b'*, 22*a"*, 22*b"*, 22*c"* 22''', 122*a*, 122*b*, 122*c*, 122*a'*, 122*b'*, 122*c'*) engages in the second recess (25*a*, 25*b*, 25*c*) and the second protrusion (24*a*, 24*b*, 24*c*) engages in the first recess (23*a*, 23*b*, 23*c*, 23*a'*, 23*b'*, 23*a"*, 23*b"*, 23*c"*, 23''', 123*a*, 123*b*, 123*c*, 123*a'*, 123*b'*, 123*c'*) for connecting the first and second feeder shells (18, 18', 18", 18''', 118, 118', 20, 20', 20", 20''', 120, 120').

4. The feeder insert according to claim 3, wherein a spacing in a range of 20 mm or less is provided between adjacent protrusions and/or recesses.

5. The feeder insert according to claim 3, wherein, measured along the central axis (Z) in sum, a section of 50% or less is free of protrusions and recesses.

6. The feeder insert according to claim 3, wherein the protrusions are formed by material appendages of residual material in inlet openings of a core box in which the feeder shell (18, 18', 18", 18''', 118, 118', 20, 20', 20", 120, 120') is manufactured.

7. The feeder insert according to claim 1, wherein the holding sleeve (26) is selected from: paper sleeve, plastic sleeve, elastomer sleeve, rubber sleeve, metal sleeve, holding sleeve formed from renewable raw materials, holding sleeve formed from a substantially residue-free combustible material.

8. The feeder insert of claim 1, wherein the feeder body (2, 2', 2", 2''', 102, 102') comprises a circumferential recess (28) for receiving the holding sleeve (26).

9. The feeder insert according to claim 1, wherein the feeder cavity (4, 4', 4", 4''', 104, 104') comprises at least one undercut.

10. The feeder insert according to claim 9, wherein the feeder cavity (4', 4", 104) is part-spherical.

11. The feeder insert according to claim 1, wherein the first and second feeder shells (18, 18', 18", 18'", 118, 118', 20, 20', 20", 120, 120') are substantially free of undercuts.

12. The feeder insert according to claim 1, wherein the feeder body (2, 2', 2", 2'", 102, 102') tapers towards the passage opening (8) and thereby defines a feeder neck.

13. The feeder insert according to claim 1, wherein the feeder body (2, 2', 2", 102, 102') comprises at least one circumferential weak section (30) which divides the feeder body (2, 2', 2", 102, 102') into a base portion (32) having the passage opening (8) and an along the central axis (Z) coaxial cap portion (34), so that the feeder body (2, 2', 2", 102, 102') is breakable in the weak section (30), when a force is applied in the direction of the central axis (Z), wherein the base portion (32) and the cap portion (34) are telescopically displaceable into one another section wise.

14. The feeder insert according to claim 1, comprising a metallic attachment arranged on the feeder body (2, 2', 2", 102, 102') around the passage opening (8) and having a collar extending in the direction of the central axis (Z).

15. The feeder insert according to claim 1, wherein the first and second feeder shells (18, 18', 18", 18'", 118, 118', 20, 20', 20", 120, 120') are substantially identically formed.

16. The feeder insert according to claim 1, wherein the feeder body (2, 2', 2", 2'", 102, 102') comprises, on an inner side facing the feeder cavity (4, 4', 4", 4'", 104, 104') and opposite the passage opening (8), a centering pin recess (15) for receiving a centering pin tip (16).

17. The feeder insert according to claim 16, wherein towards the feeder cavity (104, 104') the centering pin recess (15) comprises an insertion chamfer (17).

18. The feeder insert according to claim 1, wherein the feeder body (2, 2', 2", 2'", 102, 102') at least section-wise comprises an exothermic heating mass.

19. The feeder insert according to claim 1, wherein the feeder insert (1, 1', 1", 1'", 100, 100') has a modulus in a range from about 0.5 cm to 9 cm.

20. The feeder insert according to claim 1, comprising a metallic attachment (42) arranged on the feeder body (2, 2', 2", 2'", 102, 102') surrounding the passage opening (8) and connecting the first feeder shell (18, 18', 18", 18'", 118, 118') and the second feeder shell (20, 20', 20", 20'", 120, 120') to each other.

21. The feeder insert according to claim 20, wherein the metallic attachment (42) comprises at least one first latching element (141) and the feeder body (2, 2', 2", 2'", 102, 102') comprises at least one second latching element (142) corresponding to the first latching element (141), such that the metallic attachment (42) can be latched to the feeder body (2, 2', 2", 2'", 102, 102').

22. The feeder insert according to claim 20, wherein the metallic attachment (42) is fixed to the feeder body (2, 2', 2", 2'", 102, 102') in the manner of a bayonet catch.

23. The feeder insert according to claim 1, for use in metal casting in vertically separable casting molds, wherein the feeder body (2, 2', 2", 2'", 102, 102') is adapted for positioning by means of a centering pin (12) positionable along a centering axis (Z), and wherein the feeder cavity (4, 4', 4", 4'", 104, 104') is configured such that a predominant volume portion of the feeder cavity (4, 4', 4", 4'", 104, 104') is positionable above the centering axis (Z) when the centering axis (Z) is arranged horizontally.

24. The feeder insert according to claim 1, wherein the feeder body (2, 2', 2", 2'", 102, 102')

is formed of exothermic feeder material or comprises exothermic feeder material at least section-wise;

or is formed of insulating feeder material or comprises insulating feeder material at least section-wise;

or is formed of or includes a material selected from the group consisting of metals, plastics, paperboards, mixtures thereof, and composites thereof.

25. A method for producing a feeder insert (1, 1', 1", 1'", 100, 100') according to claim 1, comprising the steps of:

shooting a first feeder shell (18, 18', 18", 18'", 118, 118') in a core box;

shooting a second feeder shell (20, 20', 20", 20'", 120, 120') in the or a core box;

connecting the first and second feeder shells (18, 18', 18", 18'", 118, 118', 20, 20', 20'", 120, 120') to form a feeder body (2, 2', 2", 2'", 102, 102'); and arranging a holding sleeve (26) circumferentially about the first and second feeder shells (18, 18', 18", 18'", 118, 118', 20, 20', 20", 120, 120').

26. The method according to claim 25, including the step of:

forming at least one first protrusion (22*a*, 22*b*, 22*c*, 22*a*', 22*b*', 22*a*", 22*b*", 22*c*", 22'", 122*a*, 122*b*, 122*c*, 122*a*', 122*b*', 122*c*') on the first feeder shell (18, 18', 18", 18'", 118, 118') by not or not completely removing a material appendix formed by an inlet opening of the core box.

27. The method according to claim 25, wherein the step of connecting comprises:

positively connecting and/or substance-to-substance jointing.

* * * * *